US007266896B1

(12) United States Patent
White

(10) Patent No.: US 7,266,896 B1
(45) Date of Patent: Sep. 11, 2007

(54) STRING-MOUNTED BOW SIGHT

(75) Inventor: Thomas D. White, Sparta, MI (US)

(73) Assignee: Signature Enterprises, L.L.C., Sparta, MI (US)

( * ) Notice: Subject to any disclaimer, the term of this patent is extended or adjusted under 35 U.S.C. 154(b) by 36 days.

(21) Appl. No.: 10/908,291

(22) Filed: May 5, 2005

(51) Int. Cl.
*F41G 1/467* (2006.01)

(52) U.S. Cl. ..... 33/265; 124/90

(58) Field of Classification Search ..... 33/265; 124/87, 90; 42/133
See application file for complete search history.

(56) References Cited

U.S. PATENT DOCUMENTS

| | | | | |
|---|---|---|---|---|
| 4,011,853 | A * | 3/1977 | Fletcher | 124/87 |
| 4,656,746 | A | 4/1987 | Gillespie | |
| 5,347,976 | A * | 9/1994 | Saunders | 124/87 |
| 5,379,747 | A | 1/1995 | Morris et al. | |
| 5,379,748 | A | 1/1995 | Carlson | |
| 5,762,059 | A | 6/1998 | Strope | |
| 5,819,423 | A | 10/1998 | Kamola | |
| 5,996,569 | A | 12/1999 | Wilson | |
| 6,024,079 | A | 2/2000 | Ingle et al. | |
| 6,834,457 | B1 * | 12/2004 | Warren | 42/141 |
| 2002/0066220 | A1 * | 6/2002 | Malley | 42/133 |
| 2003/0019118 | A1 | 1/2003 | Wilson | |

FOREIGN PATENT DOCUMENTS

FR 2659431 A3 * 9/1991

* cited by examiner

*Primary Examiner*—R. Alexander Smith
(74) *Attorney, Agent, or Firm*—Mcgarry Bair PC

(57) ABSTRACT

A string mounted bow sight for a hunter's bow comprises a body adapted for attachment to a bow string, the arcuate body comprising a pair of arms symmetrical about a longitudinal axis to define a sighting channel, and a sighting notch extending away from the sighting channel along the longitudinal axis. The sighting channel and of the sighting notch open generally upwardly when the bowstring is drawn so that a hunter can locate a point on the hunter's prey relative to the sighting notch.

20 Claims, 9 Drawing Sheets

STRING-MOUNTED BOW SIGHT

FIELD OF THE INVENTION

The invention relates to archery bows for bow hunting. In one aspect, the invention relates to a bow sight for an archery bow. In another aspect, the invention relates to a bow-string mounted bow sight. In yet another aspect, the invention relates to a bow sight which provides a hunter with an unobstructed view of a target area of the hunter's prey.

DESCRIPTION OF THE RELATED ART

Big-game hunting is a popular pastime enjoyed by tens of thousands of participants. Deer hunting, in particular, is popular in virtually every region of the United States. The use of a bow is increasingly popular. However, compared to firearms, bows have a shorter range, and are less accurate. Noise, an arrow traveling past the prey, or excessive hunter movement can startle the prey leading to a missed opportunity. Consequently, the bow hunter frequently only has a single opportunity to make an accurate shot.

Bows have become increasingly complex weapons, and can incorporate different devices intended to improve the accuracy of the hunter's shot. A well-known hunting bow 10 is illustrated in FIG. 1. The bow 10 illustrated in FIG. 1 is a well-known compound bow comprising a somewhat flexible top limb 12, a somewhat flexible bottom limb 14, fixedly interconnected by a riser 20 having a grip 22 conforming to the hunter's hand. The top limb 12 terminates in an idler wheel 16. The bottom limb 14 terminates in a bottom cam 18. A bowstring 24 extends from the idler wheel 16 to the bottom cam 18. A sight 26 can be attached to the bow string 24.

FIG. 2 illustrates the bow 10 being drawn by a hunter 30 with a nocked arrow 28. The hunter 30 is illustrated using the sight 26 to align the hunter's line of sight 32 with the prey to accurately deliver the arrow 28 to a selected point on the prey. As illustrated in FIGS. 3A-B, the conventional bow sight 26 comprises a generally flattened, annular body comprising an annular wall 34 having an outer circumferential surface 36 and an inner circumferential surface 38 defining an ovoid aperture 40 extending coaxially therethrough. The aperture 40 has a diameter suitable for viewing an object therethrough while maintaining the size of the sight 26 small enough so as not to interfere with the movement of the bowstring 24 and the propulsion of the arrow 28. Extending radially inwardly from the outer circumferential surface 36 are two diametrically opposed pairs of string notches 42.

Referring now to FIG. 4, the bowstring 24 is illustrated as separated in a well-known configuration into independent strands for attachment of the sight 26 by receipt of the strands in the string notches 42. As illustrated in FIG. 1, the sight 26 is suspended from the bowstring 24 in a generally horizontal orientation relative to the bowstring 24. Referring to FIG. 2, as the bowstring 24 is drawn by the hunter 30, the inclination of the bowstring 24 will rotate the sight 26 to a generally angled orientation relative to the hunter's line of sight 32. The angled orientation of the sight 26 is typically designed to provide a circular appearance to ovoid aperture 40.

Typically, a hunter will prefer a point of impact that will result in relatively quick death. Referring again to FIG. 4, a portion of the prey, illustrated as a deer 44, will be visible through the aperture 40, with a limited field of view. The annular wall 34 will obscure part of the deer 44 so that the precise point of impact of the arrow will be difficult to determine. This problem is exacerbated during relatively low-light conditions. This inability to accurately determine the point of impact through the sight 26 is exacerbated when the deer 44 is positioned with one of its sides, having a generally uniform color and surface texture, facing the hunter. This frequently necessitates moving the bow 10 and the sight 26 in order to properly locate the preferred point of impact. However, such movement may be observed by the deer 44, which may become spooked and flee before the hunter can release the arrow.

There is a need for a bow sight providing a sufficient field of view to accurately locate the point of impact quickly and without unnecessary movement of the bow or hunter and which can be effectively used in low-light conditions.

SUMMARY OF THE INVENTION

A string mounted bow sight for a hunter's bow comprises a body adapted for attachment to a bow string, the arcuate body comprising a pair of arms symmetrical about a longitudinal axis to define a sighting channel, and a sighting notch extending away from the sighting channel along the longitudinal axis. The sighting channel and of the sighting notch open generally upwardly when the bowstring is drawn so that a hunter can locate a point on the hunter's prey relative to the sighting notch.

In one aspect, the invention relates to a bow sight for an archery bow adapted for attachment to a bow string, the bow sight comprising: a body being symmetrical about a longitudinal axis, and having a nose and a pair of arms symmetrical about the longitudinal axis extending away from the nose to define a sighting channel; a sighting notch extending from the sighting channel toward the nose along the longitudinal axis; wherein the bow sight is attachable to the bow string so that the sighting channel and the sighting notch open generally upwardly when the bow string is drawn so that a hunter can locate a point on the hunters prey relative to the sighting notch.

In another aspect, the invention relates to a bow sight comprising: a body having an upper surface, the upper surface of the body having an opening depending into the body, the opening extending the length of the body to define a sighting channel therethrough; and an attachment portion formed on the body and configured to receive a bow string, the attachment portion configured to position the body at an inclined angle relative to the horizontal when the bow string is undrawn and to position the body at an approximately vertical angle relative to the horizontal when the bow string is fully drawn.

A user of the sight can thereby view prey through the approximately vertical angle and have a generally unobstructed view of the prey through the opening formed in the upper surface of the body.

Various embodiments of the invention are also contemplated. For example, the arms can define a generally open upper region of the body and the sighting notch can open upwardly from the nose into the open upper region of the body. The sighting channel can be at least partially defined by opposed arcuate walls. The sighting notch can be V-shaped.

The bow sight can be attachable to the bow string by at least one string notch located on opposed sides of the body. The at least one string notch can be inclined at an angle of approximately 38 to 45 degrees. The at least one string notch can be inclined at an angle of 42.5 degrees.

The sighting notch can taper in width from a rear surface of the body to a front surface of the body. The sighting channel can comprise a V-shaped base generally aligned with a longitudinal axis of the body. The sighting channel can be further defined by a pair of opposed concave walls which extend from the upper surface of the body to an upper edge of the V-shaped base. The concave walls can provide additional viewing area to the hunter due to the configuration of the walls.

The attachment portion can comprise at least one string notch located on opposed sides of the body. The at least one string notch can be inclined at an angle of approximately 38 to 45 degrees. The at least one string notch can be inclined at an angle of 42.5 degrees.

The body can further comprise a nose opposed from the upper surface thereof. The nose can comprise a wedge-shaped portion. The wedge-shaped portion can thereby assist in wind and noise dynamics as the bow string travels from a fully drawn to an undrawn position.

DESCRIPTION OF AN EMBODIMENT OF THE INVENTION

Figure 5A:
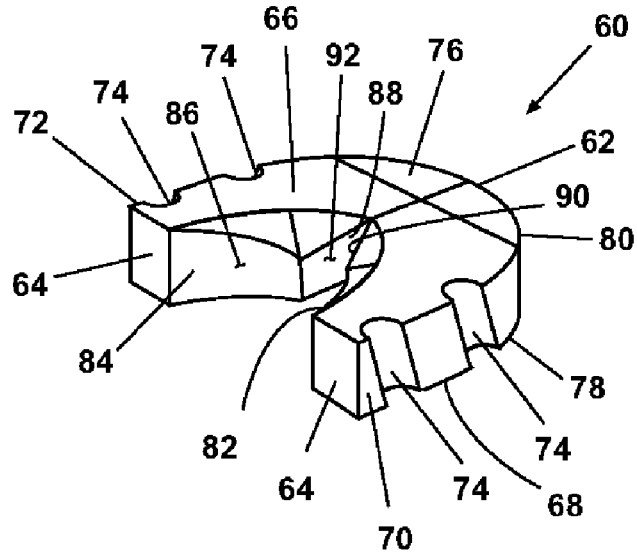
FIG. 5A is a perspective view of a bow sight according to the invention.
Figure 5B:
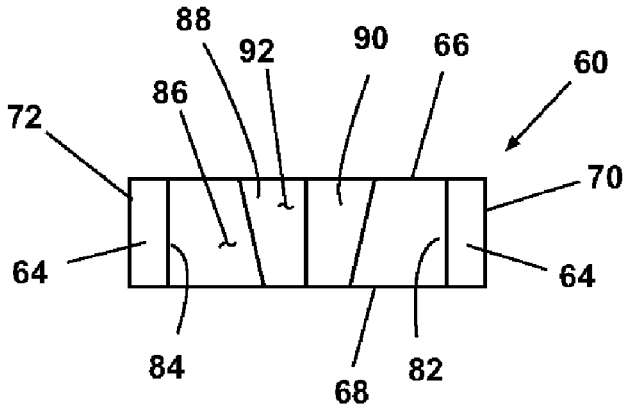
FIG. 5B is a side elevation view of the bow sight illustrated in FIG. 5A.
Figure 5C:
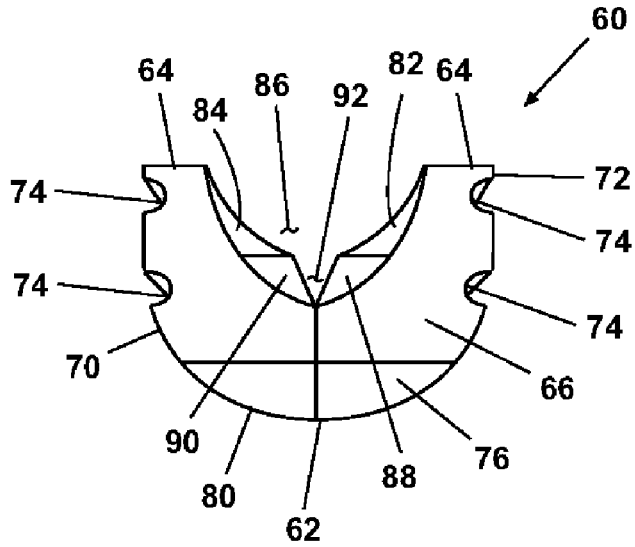
FIG. 5C is a plan view of the bow sight illustrated in FIG. 5A.

Referring now to the Figures, and in particular to FIGS. 5A-C, a bow sight 60 according to the invention is illustrated comprising a flattened, somewhat U-shaped body having a distal end 62 and a proximal end 64. As illustrated in FIG. 5A, the bow sight 60 has an upper surface 66 and a lower surface 68. When the bow sight 60 is attached to the bow string 24, the upper surface 66 will face upwardly and the lower surface 68 will face downwardly preferably when the bow string 24 is pulled to a full draw (the sight 60 can be located in an inclined position when the bow string 24 is undrawn). The distal end 62 comprises an upper inclined face 76 depending from the upper surface 66, and a lower inclined face 78 depending from the lower surface 68 to form a somewhat wedge-shaped nose 80.

Figure 1:
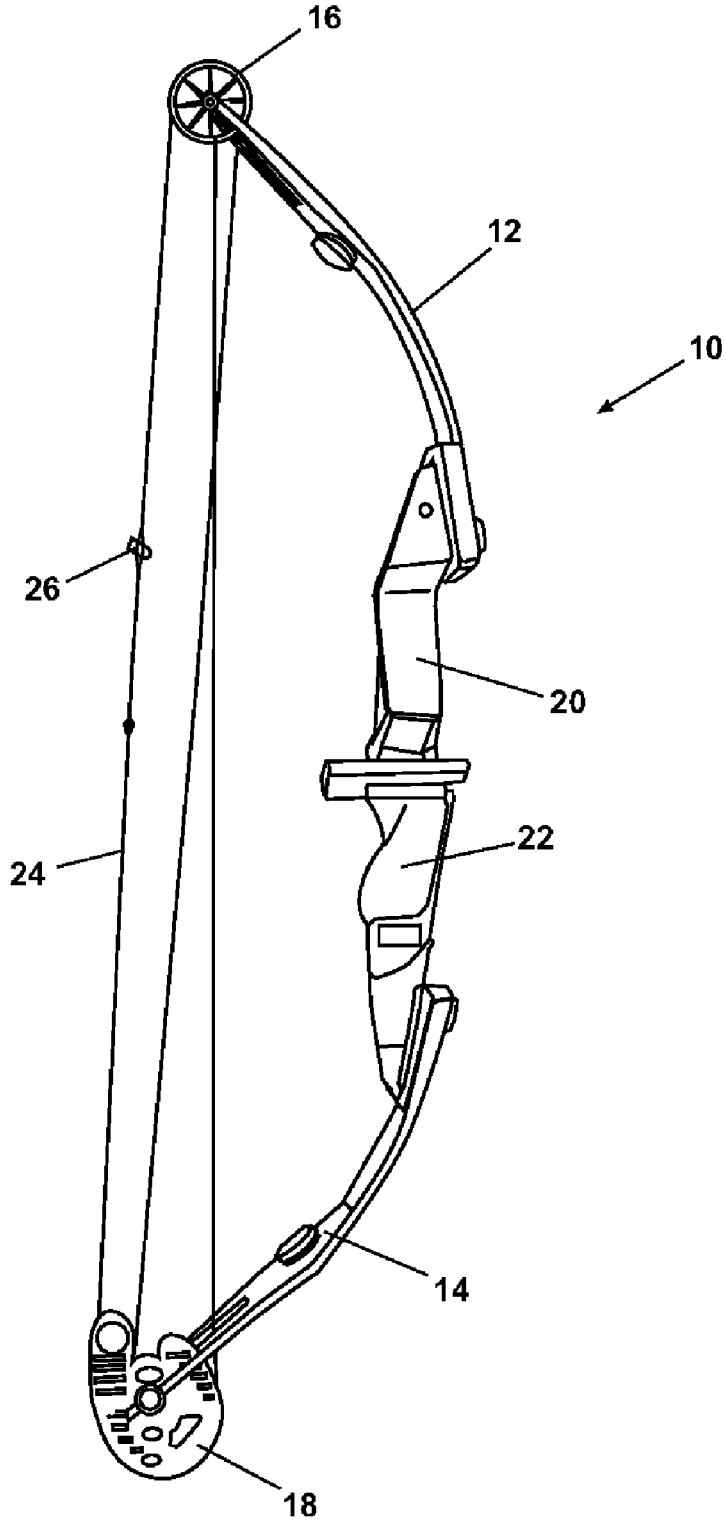
Fig. 1 (PRIOR ART)
FIG. 1 is a side elevation view of a prior art compound bow affixed with a prior art sight.
Figure 2:
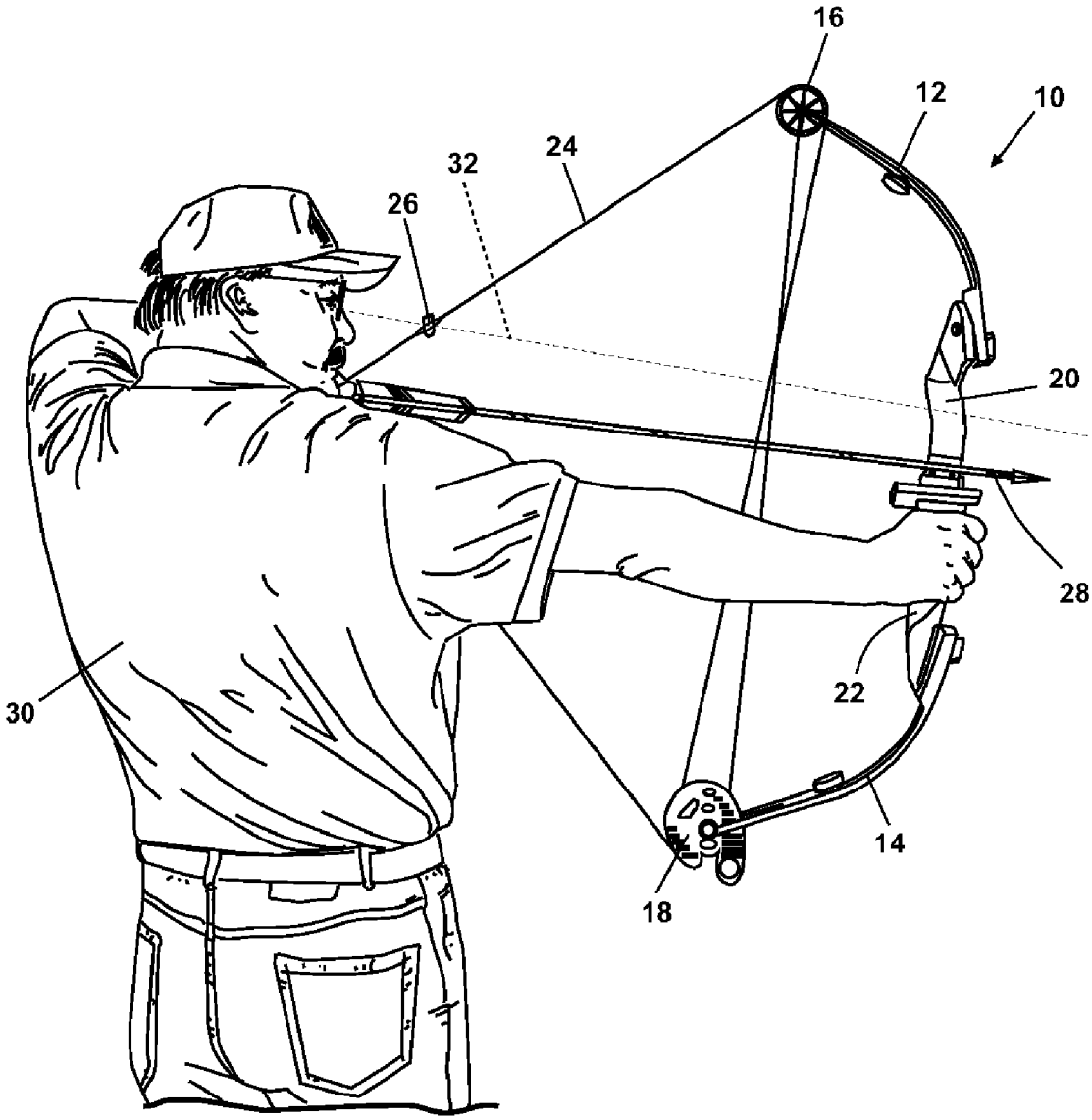
Fig. 2 (PRIOR ART)
FIG. 2 is a side elevation view of a hunter drawing the prior art bow of FIG. 1 with a nocked arrow, and illustrating the hunter's line of sight through the prior art sight.
Figure 3A:
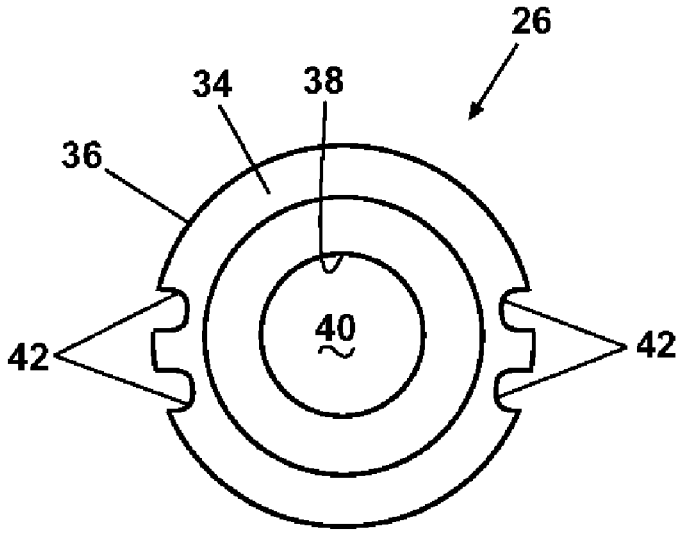
Fig. 3A (PRIOR ART)
FIGS. 3A-B are a plan view and a perspective view, respectively, of the prior art sight of FIG. 1.
Figure 3B:
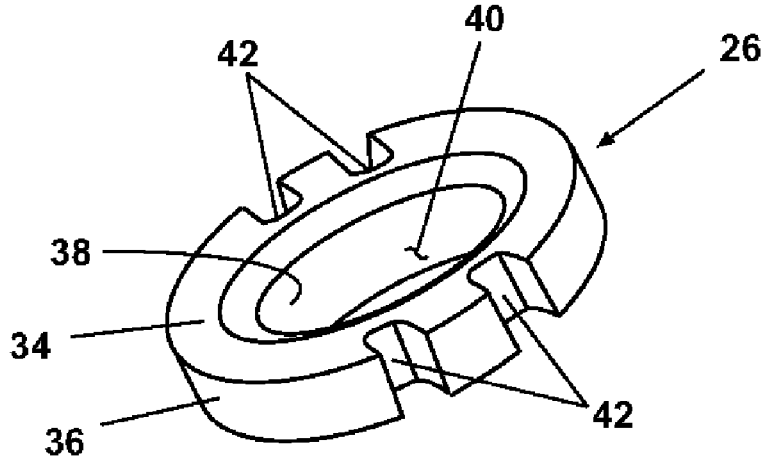
Fig. 3B (PRIOR ART)
Figure 4:
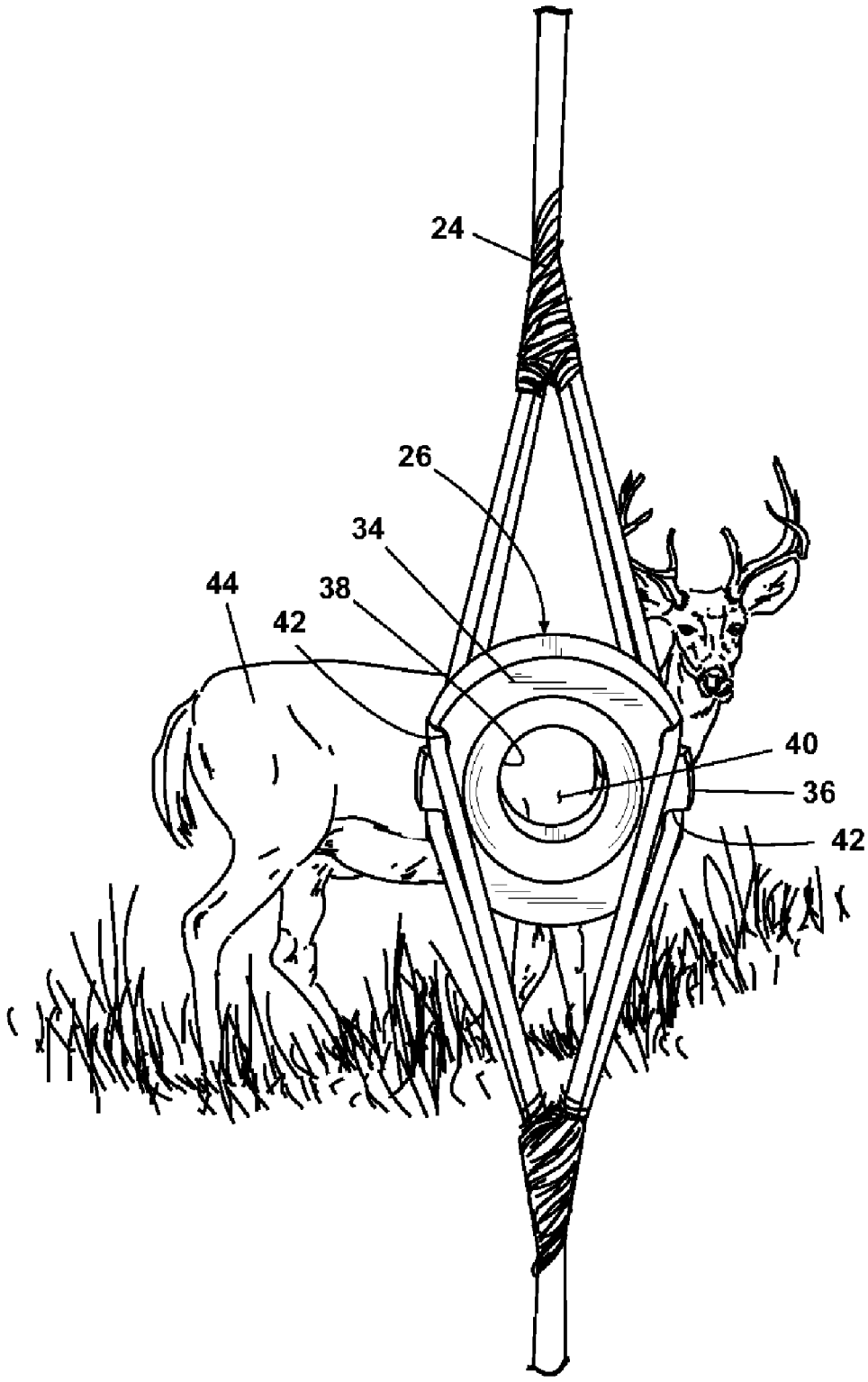
Fig. 4 (PRIOR ART)
FIG. 4 is a side elevation view of the prior art sight of FIG. 1 suspended by a bowstring, illustrating the view of a hunter's prey through the sight.

The sight 60 extends from the nose 80 toward the proximal end 64 in a pair of symmetrical side walls 70, 72 having inwardly facing arcuate walls 82, 84, respectively. The arcuate walls 82, 84 define a generally arcuate sighting channel 86 extending from the proximal end 64 toward the nose 80. Extending away from the arcuate surface 82, 84 of the sighting channel 86 are a pair of planar notch surfaces 88, 90 extending from the sighting channel 86 toward the nose 80. The notch surfaces 88, 90 define a V-shaped sighting notch 92 extending away from the sighting channel 86 toward the nose 80. Spaced between the proximal end 64 and the nose 80 are two pair of string notches 74 extending from the upper surface 66 to the lower surface 68. The string notches 74 are adapted for receipt of the strands of the bow string 24 in a manner similar to that used for the prior art sight 26 illustrated in FIG. 4.

Figure 6:
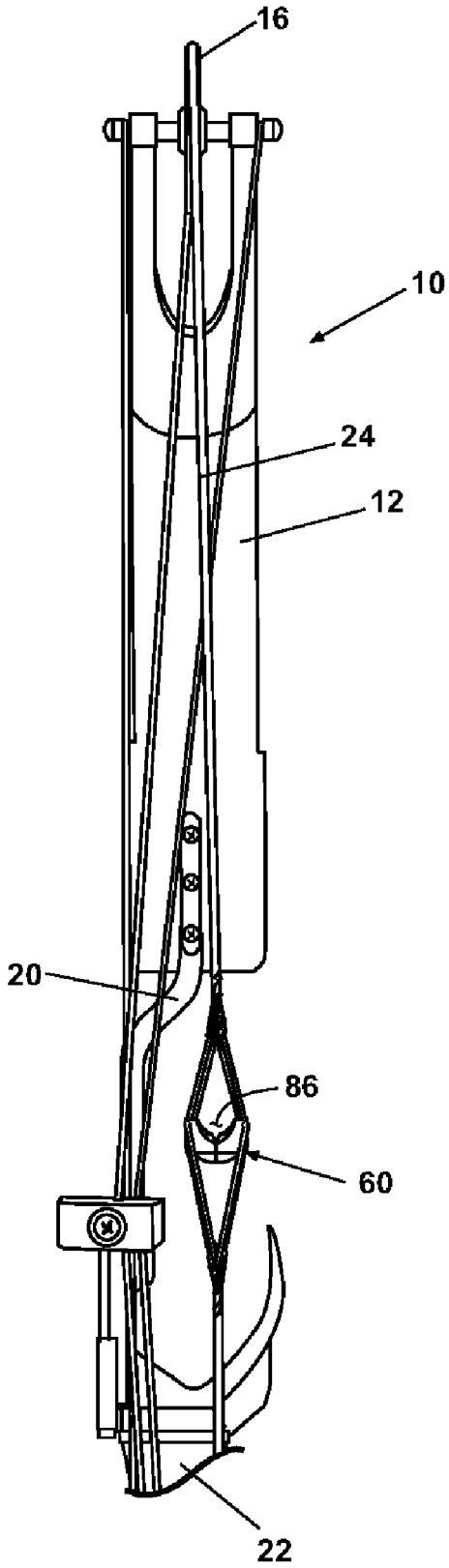
FIG. 6 is an elevation view of a portion of a prior art compound bow affixed with the bow sight illustrated in FIG. 5A.
Figure 7:
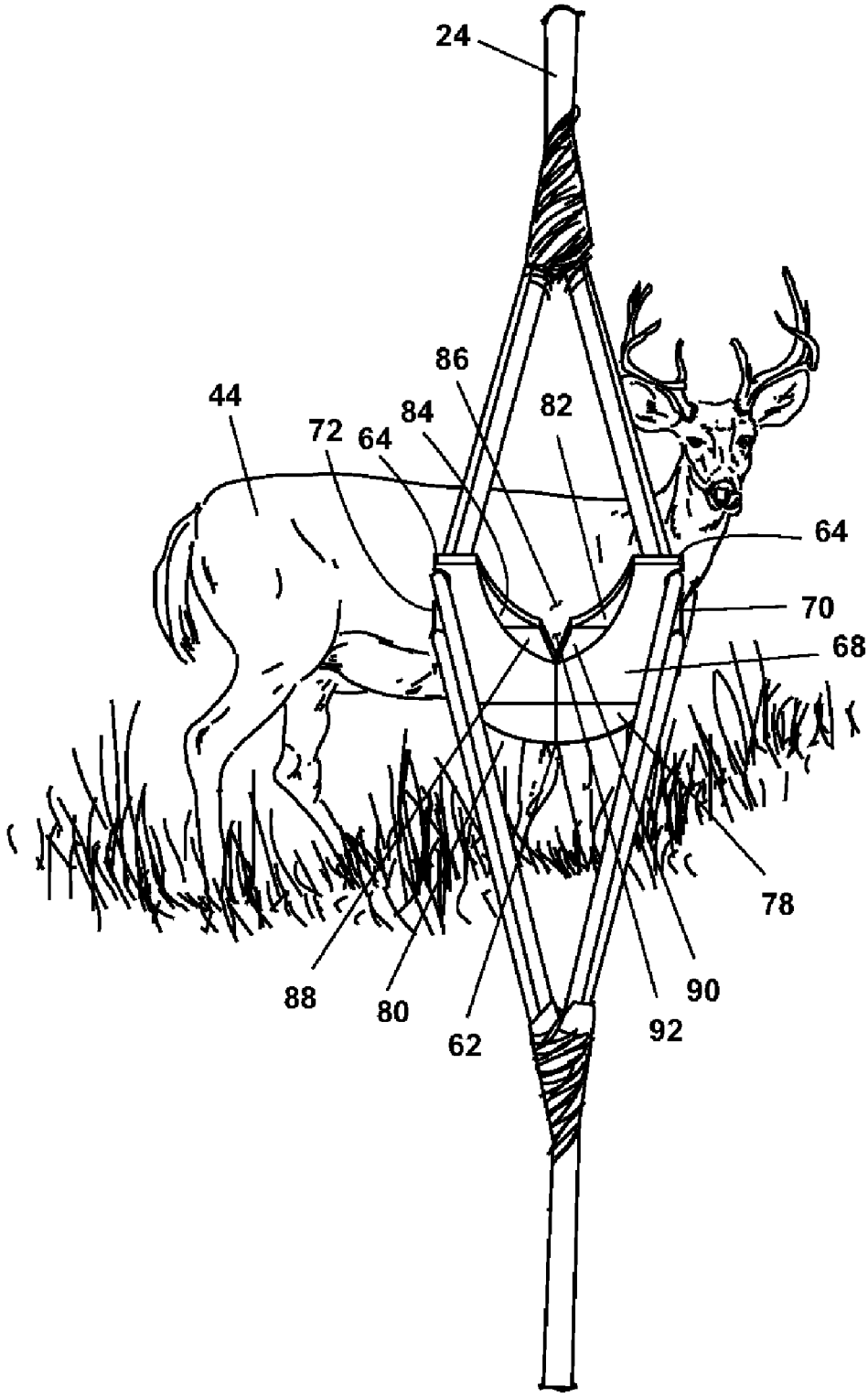
FIG. 7 is a side elevation view of the bow sight of FIG. 5A suspended by a bowstring, illustrating the view of a hunter's prey through the sight.

Preferably, the string notches 74 are inclined away from the nose 80 from the lower surface 68 to the upper surface 66 so that the nose 80 will be inclined somewhat upwardly when the sight 60 is held in the bow string 24 in an at-rest position. As illustrated in FIGS. 6 and 7, as the bow string 24 is drawn, the sight 60 will be rotated from an inclined position to a vertical position. It has been found that the angle of inclination of the string notches 74 is preferably between 38 degrees and 45 degrees. In one embodiment, the string notches are inclined at approximately 42.5 degrees. This angle of inclination will result in the sight 60 being inclined approximately vertical on a wide variety of bows (which have preferred angles of full draw between 38-45 degrees).

As illustrated in FIG. 7, the sighting channel 86 and the sighting notch 92 enable the hunter to precisely locate the impact point of the arrow with a minimum of movement and adjustment of the bow 10 or the sight 60. The hunter can immediately align the sight 60 with a selected impact point, thereby facilitating a quick shot on the prey 44, without causing movement that may spook the prey 44 (such as a quick head snap to view the prey outside of the sight—using the sight disclosed herein the hunter can effectively sight the prey while entirely viewing the prey through the sight 60). This sight is effective even in low-light conditions.

Figure 8:
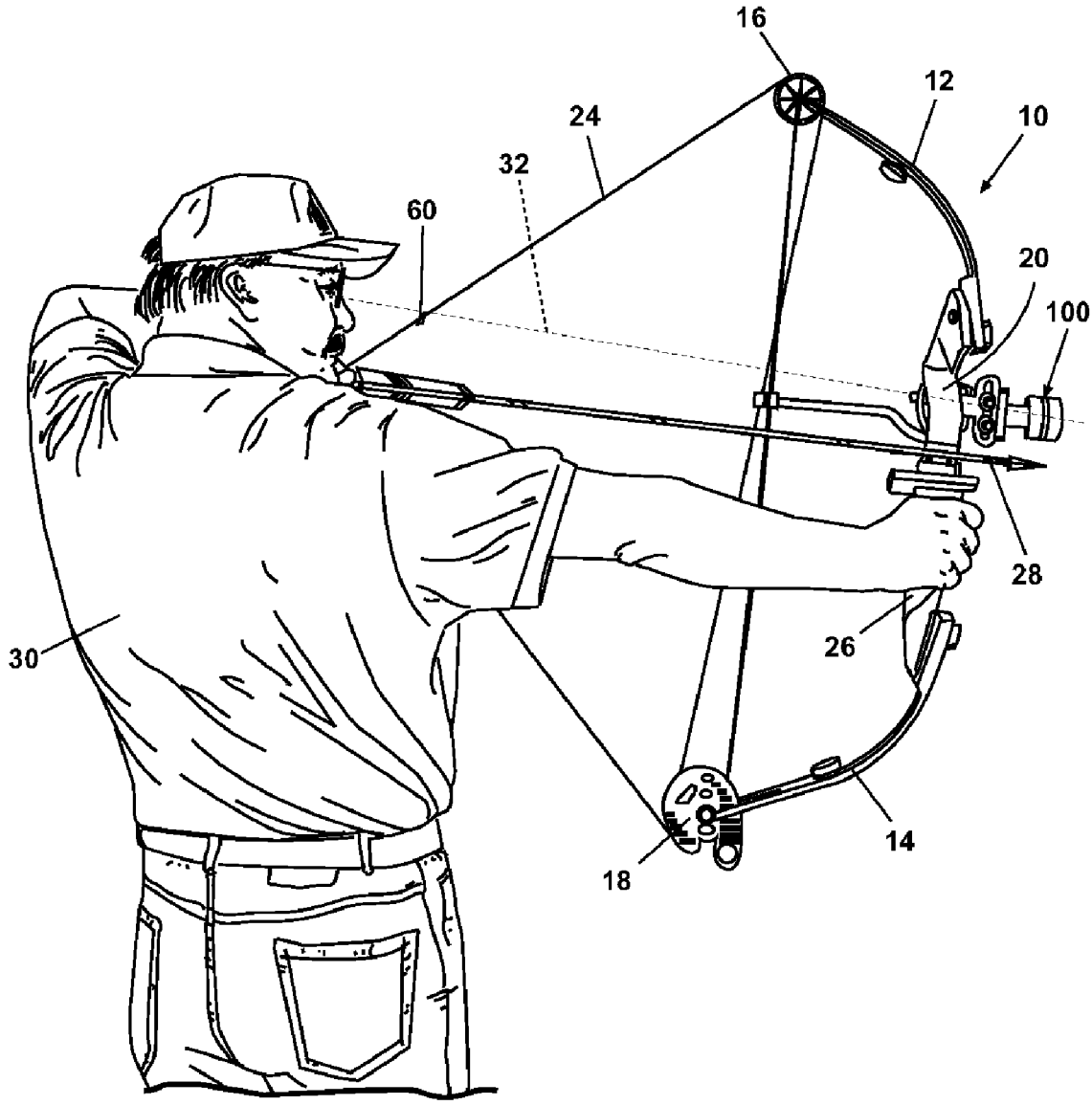
FIG. 8 is a side elevation view of a hunter drawing a bow with a nocked arrow, and illustrating the hunter's line of sight through the bow sight and a conventional front sight.
Figure 9:
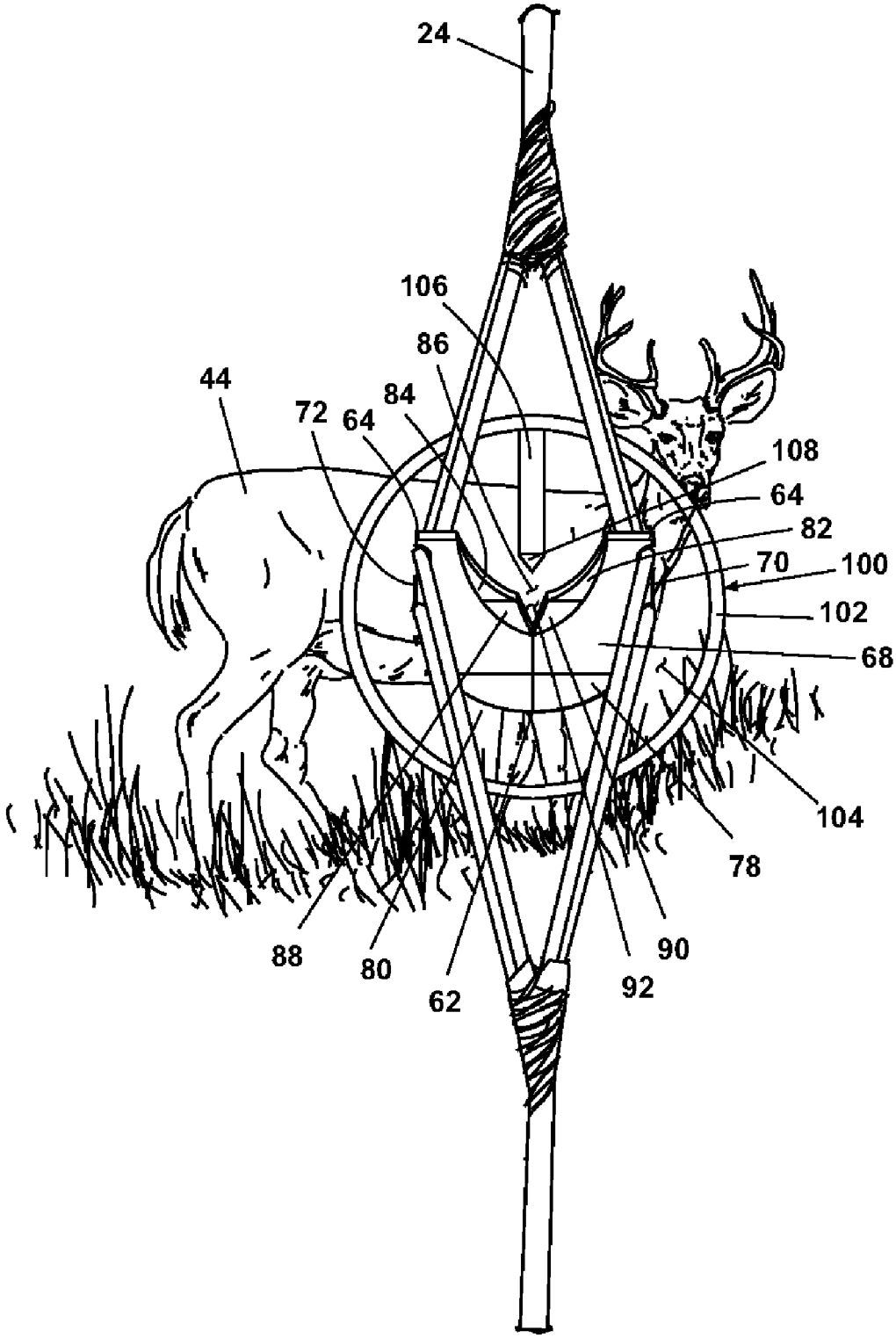
FIG. 9 is a side elevation view similar to FIG. 7, illustrating the view of a hunter's prey through the bow sight and the front sight of FIG. 8.

FIGS. 8 and 9 illustrate the bow sight 60 used with a conventional bow-mounted front sight 100. The front sight 100 comprises a ring 102 defining an aperture 104 which is oriented for axial alignment with the hunter's line of sight 32. Depending generally parallel with the bowstring 24 from the ring 102 is a typical sighting pin 106 (shown by example as a depending light-piped pin, but can comprise any suitable target-acquiring device, such as a crosshair). The sighting pin 106 can be provided with a luminescent or colored tip 108 to facilitate alignment of the pin 106 with the bow sight 60 in low light conditions. As illustrated in FIG. 9, the bow sight 60 can be aligned with the pin tip 108 by locating the pin tip 108 with the sighting notch 92 and a selected target point on the prey 44. The open sighting channel 86 and sighting notch 92 enable rapid and accurate alignment of the target point, the pin tip 108, and the sighting notch 92.

The bow sight described and illustrated herein is suspended from a bow string in a manner familiar to hunters accustomed to using a prior art suspended bow sight. The use of an open sight configuration, along with the sighting notch and the inclined string notches, provides a highly accurate bow sight which can be readily positioned to locate a preferred point of impact. The streamlined nose reduces the air resistance generated when the bow string is released, thereby reducing the sound generated by the bow sight and the potential effect of the bow sight on the movement of the string.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A bow sight for an archery bow adapted for attachment to a bow string, the bow sight comprising:

a body being symmetrical about a longitudinal axis, and having a nose and a pair of arms symmetrical about the longitudinal axis extending away from the nose to define an open-ended sighting channel;

a sighting notch extending from the sighting channel toward the nose along the longitudinal axis;

wherein the bow sight is attachable to the bow string so that the sighting channel and the sighting notch open generally upwardly when the bow string is drawn so that a hunter can locate a point on the hunters prey relative to the sighting notch;

wherein the arms define a generally open-ended upper region of the body and the sighting notch opens upwardly from the nose into the open-ended upper region of the body;

wherein the sighting channel is at least partially defined by opposed arcuate walls;

wherein the sighting notch is V-shaped;

wherein the bow sight is attachable to the bow string by at least one string notch located on opposed sides of the body; and wherein the at least one string notch is inclined at an angle of approximately 38 to 45 degrees.

2. The bow sight of claim 1 wherein the at least one string notch is inclined at an angle of 42.5 degrees.

3. A bow sight for an archery bow adapted for attachment to a bow string the bow sight comprising:

a body being symmetrical about a longitudinal axis, and having a nose and a pair of arms symmetrical about the longitudinal axis extending away from the nose to define an open-ended sighting channel;

a sighting notch extending from the sighting channel toward the nose along the longitudinal axis;

wherein the bow sight is attachable to the bow string so that the sighting channel and the sighting notch open generally upwardly when the bow string is drawn so that a hunter can locate a point on the hunters prey relative to the sighting notch;

wherein the bow sight is attachable to the bow string by at least one string notch located on opposed sides of the body; and wherein the at least one string notch is inclined at an angle of approximately 38 to 45 degrees.

4. The bow sight of claim 3 wherein the at least one string notch is inclined at an angle of 42.5 degrees.

5. A bow sight comprising:

a body having an upper surface and a lower surface, the upper surface of the body having an open-ended sighting channel extending through the body; and an attachment portion formed on the body and configured to receive a bow string, the attachment portion configured to position the body at an inclined angle relative to the horizontal when the bow string is undrawn and to position the body at an approximately vertical angle relative to the horizontal when the bow string is fully drawn;

whereby a user of the sight can view prey through the approximately vertical angle and have a generally unobstructed view of the prey through the sighting channel formed in the upper surface of the body.

6. The bow sight of claim 5 wherein the sighting notch tapers inwardly in width from the upper surface of the body to the lower surface of the body.

7. The bow sight of claim 6 wherein the sighting channel comprises a V-shaped base generally aligned with a longitudinal axis of the body.

8. The bow sight of claim 7 wherein the sighting channel is further defined by a pair of opposed concave walls which extend from the upper surface of the body to an upper edge of the V-shaped base.

9. The bow sight of claim 8 wherein the attachment portion comprises at least one string notch located on opposed sides of the body.

10. The bow sight of claim 9 wherein the at least one string notch is inclined at an angle of approximately 38 to 45 degrees.

11. The bow sight of claim 10 wherein the at least one string notch is inclined at an angle of 42.5 degrees.

12. The bow sight of claim 11 wherein the body further comprises a nose extending from the upper surface thereof.

13. The bow sight of claim 12 wherein the nose comprises a wedge-shaped portion, whereby the wedge-shaped portion assists in wind and noise dynamics as the bow string travels from a fully drawn to an undrawn position.

14. The bow sight of claim 5 wherein the sighting channel comprises a V-shaped base generally aligned with a longitudinal axis of the body.

15. The bow sight of claim 14 wherein the sighting channel is further defined by a pair of opposed concave walls which extend from the upper surface of the body to an upper edge of the V-shaped base.

16. The bow sight of claim 5 wherein the attachment portion comprises at least one string notch located on opposed sides of the body.

17. The bow sight of claim 16 wherein the at least one string notch is inclined at an angle of approximately 38 to 45 degrees.

18. The bow sight of claim 17 wherein the at least one string notch is inclined at an angle of 42.5 degrees.

19. The bow sight of claim 5 wherein the body further comprises a nose extending from the upper surface thereof.

20. The bow sight of claim 19 wherein the nose comprises a wedge-shaped portion, whereby the wedge-shaped portion assists in wind and noise dynamics as the bow string travels from a fully drawn to an undrawn position.

* * * * *